United States Patent [19]

Lazowski et al.

[11] 4,343,047

[45] Aug. 10, 1982

[54] PROTECTIVE HELMETS

[75] Inventors: James C. Lazowski, Downsview; Sharron Katz, Toronto; John A. Winship, Batawa, all of Canada

[73] Assignee: Her Majesty the Queen in Right of Canada, Ottawa, Canada

[21] Appl. No.: 199,322

[22] Filed: Oct. 21, 1980

[30] Foreign Application Priority Data

Jun. 3, 1980 [CA] Canada ..... 353324

[51] Int. Cl.[3] ..... A42B 3/02

[52] U.S. Cl. ..... 2/411

[58] Field of Search ..... 2/411, 413, 414, 415, 2/2, 16, 22

[56] References Cited

U.S. PATENT DOCUMENTS 882,686 3/1908 Ireland et al. ..... 2/413

1,652,776 12/1927 Galanis ..... 2/414 X

FOREIGN PATENT DOCUMENTS 1378494 12/1974 United Kingdom ..... 2/414

*Primary Examiner*—Peter P. Nerbun

*Attorney, Agent, or Firm*—Stevens, Davis, Miller & Mosher

[57] ABSTRACT

A protective helmet for providing protection against impact to a wearer's head. The helmet includes a helmet shell and an apparatus or component which provides for sizing and energy absorbing capabilities. This component is made of a mesh tube with loose beads of an energy absorbing material stuffed into it. The stuffed tube is flexible, preferably being coiled onto a comfort line and secured to it. The comfort liner and stuffed tube are then attached to the helmet shell. The loose beads are adjustably moveable in response to a slight amount of steady pressure as applied during donning of the helmet, to adjust so as to provide a comfortable fit to the wearer. Preferably the mesh tube is of a knitted fabric, while the beads are preferably of polystyrene. Typically, the comfort liner is of perforated leather, to be breathable.

10 Claims, 2 Drawing Figures

PROTECTIVE HELMETS

This invention relates to a protective helmet construction. More particularly, this invention relates to a sizing and energy absorbing component adapted to be worn inside a protective helmet to permit adaptation thereof to a variety of individuals.

BACKGROUND AND DESCRIPTION OF PRIOR ART

The necessity of using a protective helmet is recognized in respect of many activities, for example, in construction, in contact sports such as football or hockey, in automobile or motorcycle racing, and by pilots of aircraft etc. A wide variety of designs have been used in the past, as will be recognized by practitioners in this art. For example, assorted suspension harness arrangements have been proposed, as have constructions using liners or pads made of one or more shock absorbing materials.

The reader is directed, for example, to Canadian Pat. Nos. 941,607 which issued on Feb. 12, 1974 with Robert W. Viele as inventor, or Canadian Pat. No. 898,451 which issued on Apr. 25, 1972 with Gerard E. Morgan as inventor. The Viele patent discloses a conformable pad which uses elastomeric pellets or particles within a closed container. The particles are covered with a thin coating of lubricant so that the particles will be easily moveable one relative to another. As noted in that patent the conformable pad is described in the context of a ski boot, but "can be used for medical seat cushions or other areas where quick conformability is desired, such as shoe pads, ear defenders (noise suppressors) and the like. A football helmet made to include such a conformable pad is also described."

The Canadian Pat. No. 898,451 describes a sizing means for a helmet, which cooperates with energy absorbing means. The sizing means is described on page 4 as consisting generally of a plurality of air compartments situated over the interior surface of the helmet shell. Energy absorbing material is preferably included within these compartments, and is described as a standard resilient material, such as expanded vinyl, or expanded polystyrene beads of "STYRAFOAM" (a Trademark). As seen from FIGS. 1, 2 and 7 of that patent, the sizing and energy absorbing mechanism is complicated. Accordingly, it is questionable how reliable such a complex structure would be, especially after some usage and time have passed.

SUMMARY OF THE INVENTION

Notwithstanding the merits of prior art constructions, such as those represented by the patents noted above, the present invention is believed to embody a number of unique improvements. The invention herein is structurally simple, and partly in consequence thereof is considered to have a high degree of reliability. There are, for example, no inflatable or liquid filled chambers, as are found in the helmets of Canadian Pat. No. 898,451.

Further, the simple construction taught herein is easy to construct and at relatively low cost. No complicated assembly techniques are needed, either.

Accordingly, there is provided by this invention apparatus adapted for providing both sizing and energy absorption in a protective helmet, consisting essentially of, a mesh tube made of a textile material, and loose beads of an energy absorbing material stuffed into the tube, the stuffed tube being flexible to allow coiling of the same for placement within and subsequent attachment to a helmet shell.

In a more preferred form of the invention, there is provided a protective helmet providing protection against impact to a wearer's head; the helmet comprising, a helmet shell made of a relatively rigid material; a comfort liner conforming generally to the helmet shell, and adapted to be secured to the interior of the shell; and, an energy absorbing and sizing component consisting of a mesh tube and loose beads of an energy absorbing material stuffed into the tube, the stuffed tube being coiled over the comfort liner and secured to the same, said loose beads being adjustably moveable under a slight amount of steady pressure as during donning of the helmet, to adjust so as to provide a comfortable fit to the wearer.

Still more preferably, the mesh tube is a knitted fabric. Also, in other preferred embodiments herein the loose beads are of polystyrene.

These and other features and advantages of the invention will become apparent from the following detailed description. That description is to be read in conjunction with the accompanying drawings.

DESCRIPTION OF THE PREFERRED EMBODIMENTS

Figure 1:
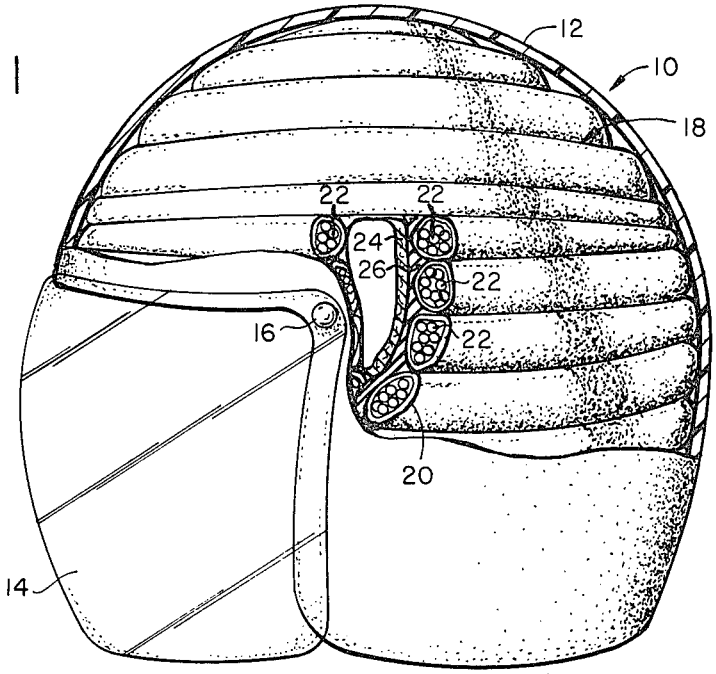
FIG. 1 is a perspective view taken partly in section to show schematically details of a preferred embodiment of this invention.

Turning to the drawings, FIG. 1 shows a helmet construction at 10, which embodies this invention. In this example which is illustrative only of a fighter aircraft pilot's helmet, the helmet 10 is seen to include a helmet shell 12 and a transparent visor 14. The mounting of the visor 14 on helmet shell 12, as well as the physical shape and characteristics of that shell are well known to designers and fabricators in this art. Typically, the visor 14 is of a material such as a polycarbonate, and the helmet shell 12 of a relatively stiff or rigid material such as a hard plastic, composite material, or metal. The visor 14 is frequently pivotally mounted to the helmet shell 12, as shown at 16.

Figure 2:
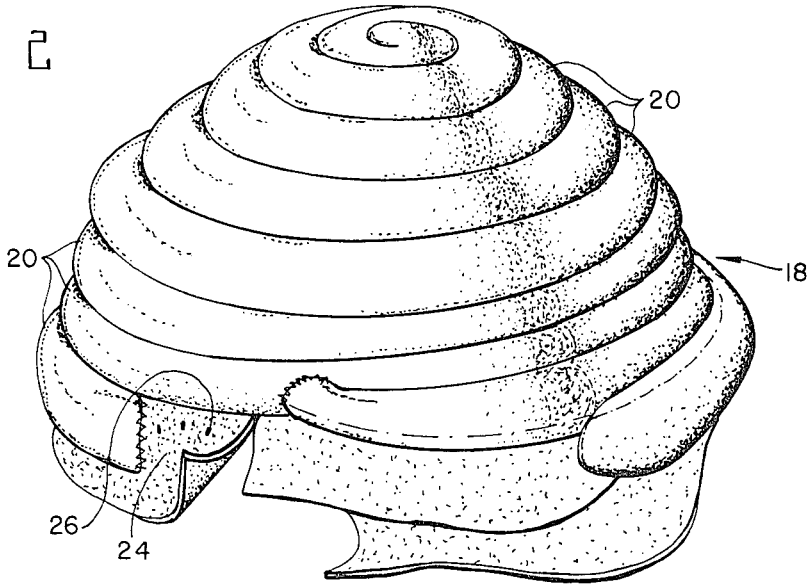
FIG. 2 is also a perspective view to show schematically structural detail of the sizing and energy absorbing component of this invention.

A sizing and energy absorbing component is represented by 18. More particularly, the component 18 consists essentially of a mesh tube 20 filled with loose beads 22. FIG. 1 shows the beads 22 greatly exaggerated in size, which typically are about 1.0 mm diameter. The tube 20 is typically of a woven or knitted fabric or cloth having a loose mesh so as to be breathable. The material is an open weave nylon polyester which is commercially available. Tube 20 is made for example, from a strip of material 3"–4" in width, sewn into a cylindrical form. The loose beads 22 are also commercially available, and are introduced into the tube 20 by being sucked along and driven by air pressure. The beads 22 are compactly driven into the tube 20 so as to form a cylinder of about 1" diameter, and preferably, in the range from about $\frac{3}{4}$" to about $1\frac{1}{4}$". The actual diameter is governed by the standoff distance in a particular helmet, that is, the spacing between a typical wearer's head and the inside surface of the helmet shell. The maximum spacing is usually found in sports or workman's helmets where constraints of space in the environment where it is used, is missing. An aircrew helmet, for example, is typically worn in constricted spaces and will have a smaller standoff distance or clearance. Loose beads 22 are stuffed, poured or otherwise introduced into the tube substantially to fill the same. The beads 22 are moveable one relative to another, and have sufficient resiliency in conjunction with the mesh tube 20 to allow the stuffed tube to be coiled as shown in FIG. 2. In practice the stuffed tube is coiled onto a comfort liner 24 and attached to the same, for example, by a layer of adhesive, stitching or the like. The attachment is normally permanent, but could be releasable if desired. Stitching is the preferred form of attachment. The use of an adhesive could introduce pressure points, as could patches of "VELCRO"* which in any event would be bulky.

*(a Trademark)

The comfort liner 24 is preferably of leather, perforated as shown at 26 to permit/foster some ventilation. The comfort liner 24 is configured generally hemispherically so as to conform to the wearer's head.

In fabricating a protective helmet according to this invention, the stuffed tube 20 is coiled onto the comfort liner 24, secured to it, and then secured to the helmet shell 12. Attachment to the shell 12 may be by a releasable element such as a pad of "VELCRO"*, by a double faced tape or the like. Further, a friction fit is likely to be sufficient to hold the interior assembly in place.

In the preferred embodiment, the loose beads 22 are of polystyrene, although other materials having the same physical properties could be used. The stuffed tube 20 has sufficient flexibility to be coiled easily. Individual fit is achieved by donning and nestling the wearer's head into the liner. The loose beads shift around, moving one relative to another, to accommodate the contours of the wearer's head. Attenuation of impact loads and forces is obtained by a progressive crushing of the beads and motion of the beads inside the tube.

Load attenuation is excellent and certainly acceptable in accordance with the following results:

Windblast, at Mach 0.75 for assessing stability and retention under dynamic forces—the helmet of this invention remained on the headform, with observable movement relative thereto, being less than ⅜ inches.

Impact, vertical guided freefall of a magnesium alloy headform wearing the helmet of this invention, onto a flat steel anvil imparted 65 foot-pounds of impact energy to the crown of the helmet. An acceleration of less than 140 G was transmitted to the centre of gravity of the headform. The entire pulse lasted approximately 12 milliseconds.

These compare very closely to results obtained for aircrew helmets currently in use.

The simplicity of the present invention will be readily apparent, for example, the mesh tubes could be made using a household sewing machine, and textile fabric that is readily available. Moreover, the loose beads when stuffed into the mesh tube will permit a considerable amount of flexibility due to being free to roll or move relative to one another in all directions. On the other hand, being contained within the tube and then between the wearer's head and the helmet shell causes the impact loads to be distributed over a large area. Individually the beads are easily and rapidly crushable, but collectively they act to disperse and absorb the applied load in a more controlled manner. Also, being loose and within a mesh tube beneath a breathable comfort liner, the beads allow the dissipation of heat, and ventilation.

Modifications to the preferred design described above will be apparent to those skilled in this art. It is intended that all such modifications be envisaged by this invention as fall within the scope of the claims below.

The embodiments of the invention in which an exclusive property or privilege is claimed are defined as follows:

1. Apparatus for providing both sizing and impact energy absorption in a protective helmet, comprising:

(a) a flexible, air permeable mesh tube made of a textile material; and (b) loose beads of an energy absorbing material stuffed into said mesh tube to substantially fill the same, the stuffed tube being coiled so that adjacent coils abut one another, the stuffed coiled tube being attachable to the interior of the protective helmet so that said loose beads, during donning and nestling of the stuffed coiled tube helmet by a wearer, shift to conform to the contours of the wearer's head, while simultaneously providing a capability for attenuation of an impact load on the helmet by progressive crushing of the beads combined with motion of individual beads within said tube to distribute said impact load.

2. The apparatus defined in claim 1, wherein said mesh tube comprises one of a knitted or woven fabric.

3. The apparatus defined in claim 1, wherein said beads are of polystyrene.

4. The apparatus defined in claim 1, 2 or 3, wherein a comfort liner is provided, with the stuffed tube being coiled over and attached to said liner, and the liner is attachable to said protective helmet.

5. The apparatus defined in claim 1, 2 or 3 wherein a porous comfort liner is provided, the stuffed tube being coiled over said liner and secured to the same.

6. A protective helmet providing protection against impact to a wearer's head, said helmet comprising:

(a) a helmet shell made of a relatively rigid material and generally spherical in shape;

(b) a comfort liner conforming generally to said helmet shell, the liner being of a smaller size than the helmet to define a space between the liner and the shell, said liner being adapted to be attached to the interior of said shell; and (c) an impact energy absorbing and sizing component consisting of a flexible air permeable mesh tube made of a textile material, and loose crushable beads of an energy absorbing material stuffed into said tube substantially to fill the same, said tube being generally circular in cross-section and having a diameter in the range of about 0.75" to about 1.25", and coiled to a generally hemispherical shape with adjacent coils abutting one another, the stuffed coiled tube being positioned over the comfort liner and secured to the same so as substantially to fill said space, such that said loose beads, during donning and nestling of the helmet, shift to conform to the contours of a wearer's head, while simultaneously providing a capability for attenuation of an impact load on the helmet by progressive crushing of the beads combined with motion of individual beads within the tube to distribute said load.

7. The protective helmet defined in claim 6, wherein the comfort liner is porous.

8. The protective helmet defined in claim 6, wherein said mesh tube is of a knitted fabric.

9. The protective helmet defined in claim 6, wherein said loose beads are of polystyrene.

10. The protective helmet defined in claim 6, 8 or 9, wherein the comfort liner is of perforated leather to be breathable, and the energy absorbing and sizing component is of a cloth mesh tube stuffed with loose beads of polystyrene, nestling of the wearer's head against the comfort liner causing the loose beads to be repositioned so as to provide a close, comfortable fit to said wearer.

* * * * *